United States Patent [19]

Jani

[11] Patent Number: 4,487,263

[45] Date of Patent: Dec. 11, 1984

[54] CEMENT STAGING APPARATUS FOR WELLS AND INCLUDING WELL CASING AND A PROCESS THEREFOR

[76] Inventor: William Jani, 2-3401-19 St. NE. Calgary, Alberta, Canada, T2E658

[21] Appl. No.: 453,166

[22] Filed: Dec. 27, 1982

[51] Int. Cl.[3] ..... E21B 33/13; E21B 33/16

[52] U.S. Cl. ..... 166/289; 166/154; 166/194; 166/324

[58] Field of Search ..... 166/285, 289, 311, 381, 166/383, 387, 153, 154, 156, 177, 185, 194, 321, 164, 169, 317, 318, 179, 196, 324

[56] References Cited

U.S. PATENT DOCUMENTS

| | | | |
|---|---|---|---|
| 2,435,016 | 1/1948 | Pitts | 166/289 |
| 2,488,819 | 11/1949 | Larkin | 166/194 |
| 3,097,698 | 7/1963 | Corley, Jr. et al. | 166/169 |
| 3,451,476 | 6/1969 | Pitts | 166/318 |
| 3,789,926 | 2/1974 | Henley et al. | 166/318 |
| 3,948,322 | 4/1976 | Baker | 166/154 |
| 4,260,017 | 4/1981 | Nelson et al. | 166/154 |

FOREIGN PATENT DOCUMENTS

| | | | |
|---|---|---|---|
| 0047906 | 8/1979 | U.S.S.R. | 166/318 |
| 0048008 | 9/1980 | U.S.S.R. | 166/285 |
| 0048104 | 8/1981 | U.S.S.R. | 166/285 |

OTHER PUBLICATIONS

"Multiple Stage Cementing uses 2 and 3-Stage Methods" by Montgomery, World oil, 12/1954.

*Primary Examiner*—Stephen J. Novosad
*Assistant Examiner*—William P. Neuder
*Attorney, Agent, or Firm*—Shlesinger, Arkwright Garvey & Fado

[57] ABSTRACT

A cement staging apparatus for wells and including well casing, comprising an open ended hollow body having a number of spaced ports therethrough; a first hollow member slideably associated with said body and having a first ports closed position and a second ports open position; first pressure associated with said first member for displacing said first member and opening said ports thereby; a second hollow member slideably associated with said body and having a first ports open position and a second ports closed position and including shifting pressure relieving means associated with said body; second pressure means associated with said second member for displacing said second member and closing said ports thereby; said second member spaced a distance from said first member; said body, said member and said first pressure means defining a canister having an open end for receipt of a supply of pressurized cement and adapted for distributing said cement through said ports; and said body, said first and said second pressure means and said second member defining a closed canister for preventing the distribution of an additional supply of cement whereby closing of said canister by said second pressure means causes said pressure relieving means to shift thereby and relieve said canister pressure.

37 Claims, 15 Drawing Figures

FIG 11
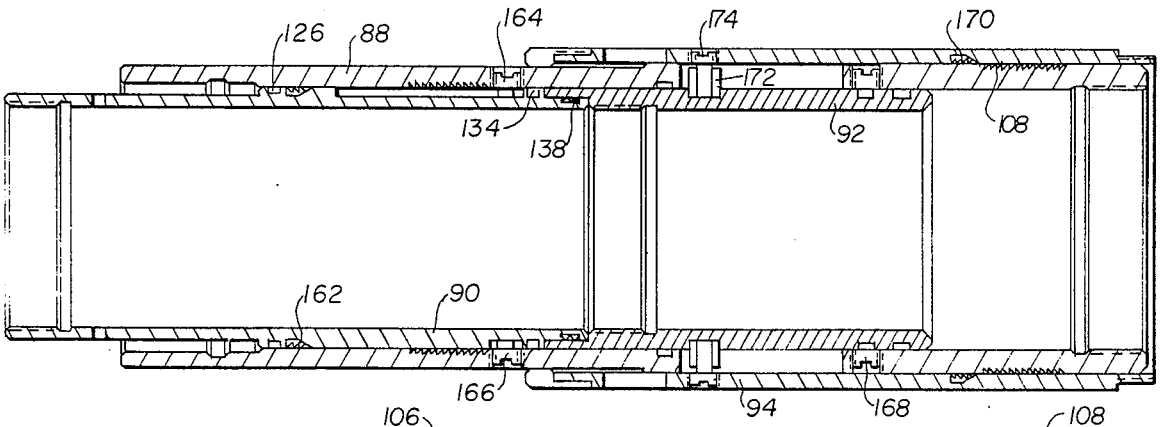
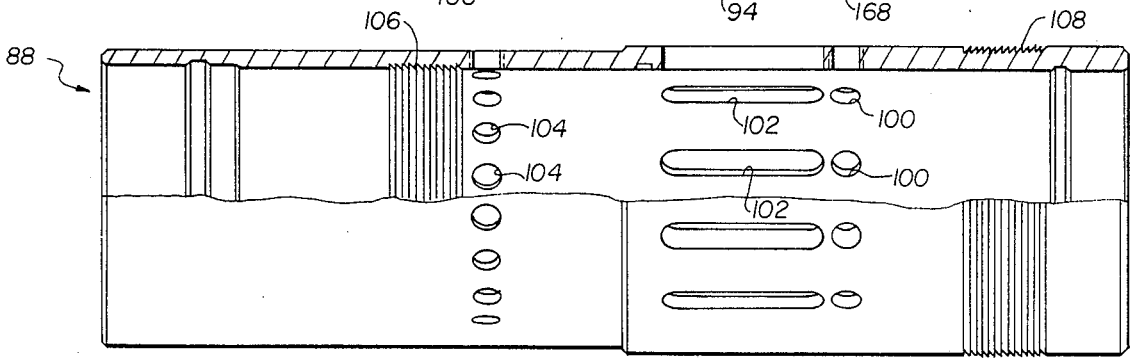
FIG 8
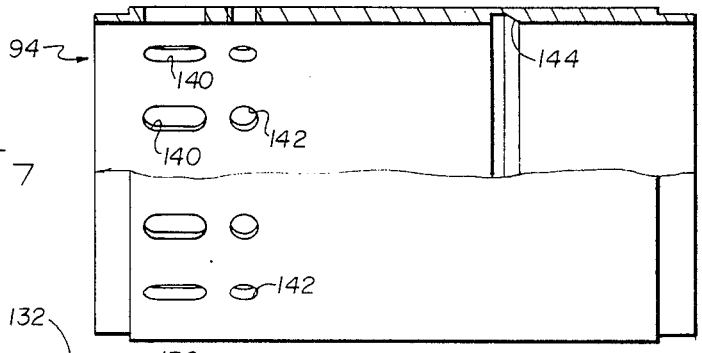
FIG 7
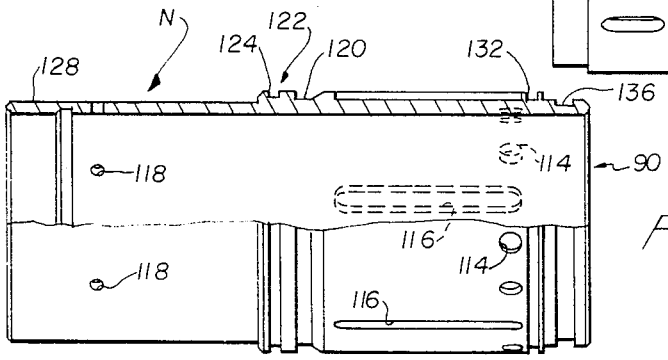
FIG 10
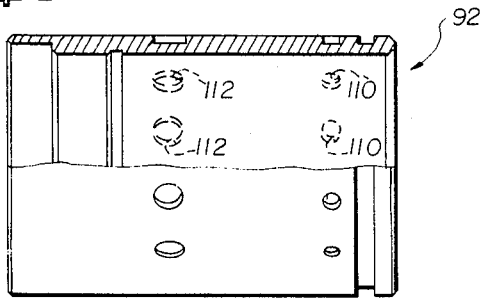
FIG 9

CEMENT STAGING APPARATUS FOR WELLS AND INCLUDING WELL CASING AND A PROCESS THEREFOR

BACKGROUND OF THE INVENTION

During the drilling into the earth of an oil or gas well, the bore hole may pass through several different strata, each stratum having its own particular characteristics. If the well casing is not cemented into the bore hole, then the contents of the various strata will become mixed and the products of undesirable strata may block the desirable products of other strata.

The cementing of well casing in a bore hole is well known in the art. For relatively shallow or deep wells the cementing of the well casing in the bore hole has been easily accomplished by pumping cement down the well casing and out the bottom of the casing to fill the bore hole from the bottom. It is then a relatively simple procedure to drill out the cement in the casing after the cement has properly hardened.

However, it has become much more difficult to cement the well because of the pressure gradient involved in pumping the cement from the bore . hole bottom to the top.

The disclosed invention provides a new and unique apparatus and process for cementing well casing in a bore hole. The disclosed invention provides an apparatus and process for cementing the well in at least two stages, one stage located above the other. The apparatus of the invention allows cement to be pumped both from the bottom of the bore hole and from a point somewhere intermediate the bottom and the top.

OBJECTS OF THE INVENTION

It is a primary object of the disclosed invention to provide an apparatus and process for cemeting well casing in a bore hole in stages.

It is a further object of the disclosed invention to provide an apparatus and a process for cementing well casing in a bore hole in stages in which the stages are free to cure independently of each other.

Yet another object of the disclosed invention is to provide an apparatus for distributing cement in a bore hole which apparatus may be positioned at a preselected point in the well.

Still another object of the disclosed invention is to provide an apparatus whose cement distribution ports may be selectively opened and closed by the application of pressure.

Still a further object of the disclosed invention is to provide an apparatus having means for relieving the pressure in the cement distribution apparatus which arises from the closing of the apparatus and the distribution ports.

Still yet another object of the disclosed invention is to provide an apparatus and a process in which a substantial portion of the internal volume of the well casing is not filled with cement.

Yet a further object of the disclosed invention is to provide an apparatus and a process which permits the use of lower pumping pressures for cementing a given well than is available now.

Still yet another object of the disclosed invention is to provide an apparatus having a packer ring for sealing the well casing in the bore hole and isolating the first cementing stage from the second cementing stage so that the second stage may be pumped prior to the first stage being cured.

Still a further object of the disclosed invention is to provide an apparatus whose closure mechanism wipes clean the inside of the well casing prior to closing the cement distribution ports.

Yet one more object of the dislcosed invention is to provide an apparatus which prohibits the cement from backing up through the well casing.

The methods and other objects and advantages of the disclosed invention will be further apparent from the following description and claims.

DESCRIPTION OF THE DRAWINGS

In the accompanying drawings which illustrate by way of example various embodiments of this invention:

FIG. 7 is a longitudinal cross-sectional view with portions broken away of the outer sleeve of the embodiment disclosed in FIG. 6A;

FIG. 8 is a longitudinal cross-sectional view with portions broken away of the body of the embodiment disclosed in FIG. 6A;

FIG. 9 is a longitudinal cross-sectional view with portions broken away of the opening sleeve of the embodiment disclosed in FIG. 6A;

FIG. 10 is a longitudinal cross-sectional view with portions broken away of the closing sleeve of the embodiment disclosed in FIG. 6A; and FIG. 11 is a longitudinal cross-sectional view with a section of 135° broken away and disclosing the apparatus of FIG. 6A in its assembled state.

DESCRIPTION OF THE INVENTION

As best shown in FIGS. 1A through 1D, a length of well casing C is connected to a cement distribution apparatus A located in a well bore hole H.

Figure 2:
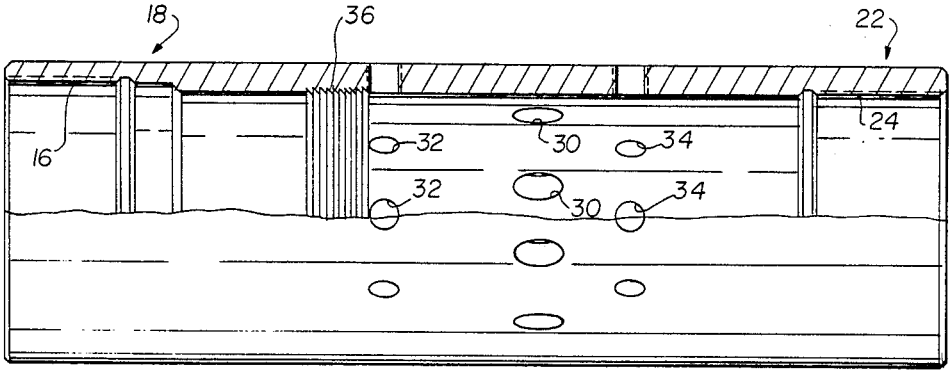
FIG. 2 is a fragmentary cross-sectional view with parts broken away and disclosing the body of the apparatus A and the cement distribution ports.
Figure 4:
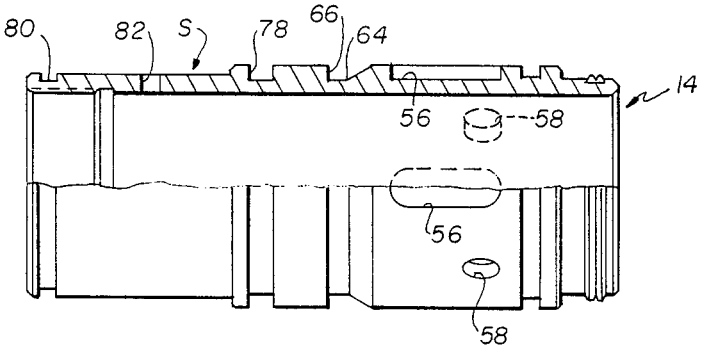
FIG. 4 is a cross-section view with portions taken away of the closing sleeve of the apparatus A.
Figure 5:
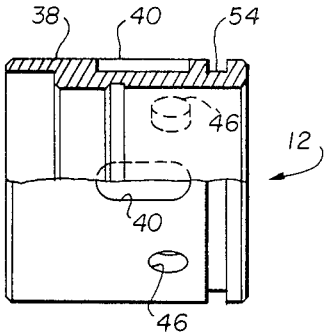
FIG. 5 is a cross-sectional view with portions broken away of the opening sleeve of the apparatus A.

The cement distribution apparatus A is comprised generally of a body 10, as best shown in FIG. 2; an opening sleeve 12, as best shown in FIG. 5; and a closing sleeve 14, as best shown in FIG. 4.

As best shown in FIGS. 1 and 2, the body 10 is of a substantially cylindrical, hollow, open ended configuration. Annular body 10 has internal threads 16 at its upper end 18 for connecting with and co-operating with annular coupler 20 which is likewise threaded for engaging the threads 16 of body 10 and the threaded end of well casing C and for connecting therewith. Similarly, the lower end 22 of body 10 is threaded at 24 for engaging threaded coupler 26. A standard collar 28 connects coupler 26 to a length of well casing C. It should be appreciated that any number of lengths of well casing C may be joined by standard couplers 28 so that cement distribution apparatus A may be positioned by its couplers 26 and 20 at any desired position in bore hole H.

As best shown in FIGS. 1 and 2, body 10 has a number of spaced sized radially extending cement distribution apertures or ports 30. Body 10 contains a number of apertures 32 and 34 axially aligned and located at a distance from ports 30. Body 10 contains, preferentially, 8 ports 30 equiangularly spaced about body 10 as well as 8 apertures 32 and 8 apertures 34 likewise equi-angularly spaced around body 10. Apertures 32 and 34 are axially aligned with one another.

Referring again to FIG. 2, body 10 has a number of sized spaced, annular co-axial, co-operating toothed flanges or indentations 36 extending circumferentially around body 10 interior at a distance from apertures 32.

Hollow, open ended annular closing sleeve 12 is slidingly mounted in body 10 and has an axially extending flange 38 which blocks ports 30 initially. Opening sleeve 12 has four longitudinally extending slots 40 equi-angularly positioned about sleeve 12 and co-operating with apertures 34 in body 10. Guiding bolts 42, as best shown in FIG. 1B, are positioned in apertures 34 and enter slots 40 to prevent rotation of opening sleeve 12 and also to prevent sleeve 12 from being displaced too far. Bores 46 are equi-angularly positioned around sleeve 12 and between slots 40. Bores 46 and slots 40 do not pass through sleeve 12. Frangible bolts 44 located in every other aperture 34 enter into bores 46 located in sleeve 12. Frangible bolts or shear screws 44 have a shear value of approximately 3,760 pounds and act to detachably secure opening sleeve 12 in body 10. Sleeve 12 is not free to be displaced in body 10 until frangible bolts or shear screws 44 have been broken. An opening seat or opening collar 48 is positioned in opening sleeve 12 co-axial with body 10 and has a central aperture 50 which is flared outwardly at its upper end. Opening seat or collar 48 is preferably threaded and screwed into sleeve 12 but other fastening mechanisms are possible. An O-ring or other flexible sealing mechanism 52 surrounds sleeve 12 and is maintained in circumferential groove 54. In this way sleeve 12 is sealed to body 10.

Closing sleeve 14 is positioned above opening sleeve 12 and is similarly substantially cylindrical hollow and open ended. Closing sleeve 14 has four longitudinally extending guide slots 56, as best shown in FIG. 4, equi-angularly spaced around its circumference.

Similarly, bores 58 are equi-angularly spaced around sleeve 14 such that bores 58 are equi-angularly positioned between slots 56. Bores 58 and slots 56 do not penetrate through sleeve 14. Guide bolts 60 are positioned in apertures 32, as best shown in FIG. 5, to enter and co-operate with guide slots 56 and prevent closing sleeve 14 from rotating. Similarly, frangible bolts or shear screws 62 are positioned in apertures 32 to enter bores 58 so as to detachably secure closing sleeve 14 to body 10. Frangible bolts or shear screws 62 are similar to frangible bolts 44 and have a shear value of approximately 3,760 pounds. Consequently, closing sleeve 14 is not free to move in body 10 until shear screws or frangible bolts 62 are broken. Although frangible screws 62 and 44 are disclosed as having a shear value of approximately 3,760 pounds, it can be appreciated that other shear values, either greater or lower, may be used in the appropriate case.

Figure 3:
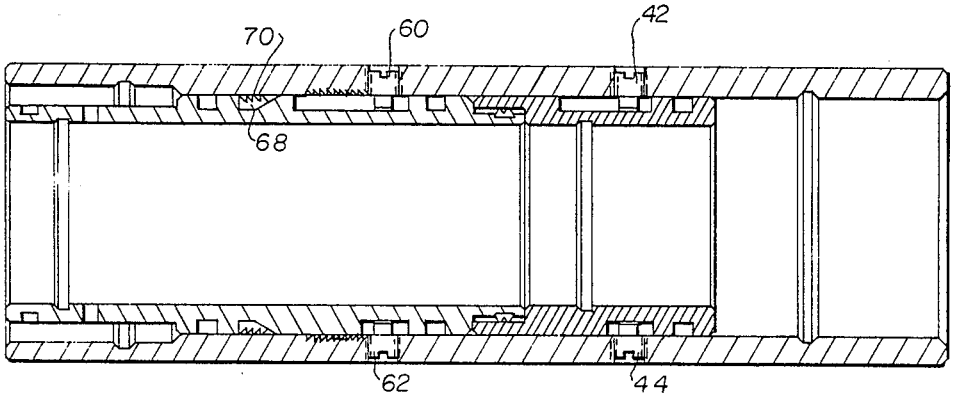
FIG. 3 is a longitudinal cross-sectional view of the apparatus with a section of 135° broken away and disclosing the apparatus A in its assembled state.

Circumferentially extending around the exterior of closing sleeve 14 is notch 64. Notch 64 is positioned above the upper end of guide slots 56 and has a radially extending shoulder 66 for holding a retaining ring 68 positioned in notch 64, as best shown in FIG. 3. Retaining ring 68 has a number of spaced, co-axial, co-operating toothed flanges 70 for engaging toothed flanges 36 and for thereby holding closing sleeve 14 in position when closing sleeve 14 has been axially displaced to close ports 30. Toothed flanges 70 have a ratchet type action and progressively advance along toothed flanges 36 until ports 30 are complete closed. Sleeve 14 may move in our direction only because toothed flanges 70 and 36 engage each other and prevent sleeve 14 from being displaced toward the upper end 16 of body 10. O-ring 72 seals sleeve 14 to body 10 and O-ring 74 seals sleeve 14 to coupler 20. Resilient seal 76 seals the lower end of sleeve 14 to body 10.

As best shown in FIG. 4, sleeve 14 has a constant internal diameter throughout its length. Beyond shoulder 66 and groove 78 used to hold O-ring 72, the external diameter of sleeve 14 diminishes and the thickness of sleeve 14 remains constant along the length of shoulder S. At the upper end of shoulder S is groove 80 used to hold O-ring 74. Two apertures 82 radially extend through shoulder S approximately midway its length.

Figure 1A:
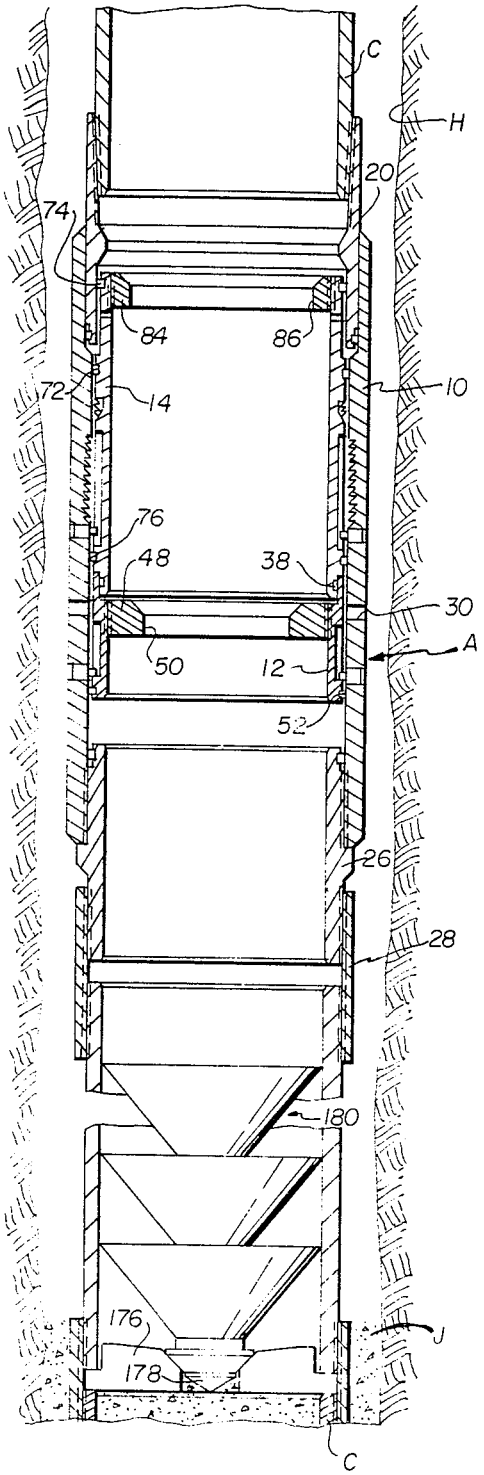
FIG. 1A is a fragmentary longitudinal cross-sectional view of the apparatus of the invention and disclosing the well casing, including the cement distribution system A, located in a well bore hole and further disclosing the cement distribution system A, in its initial state.
Figure 1B:
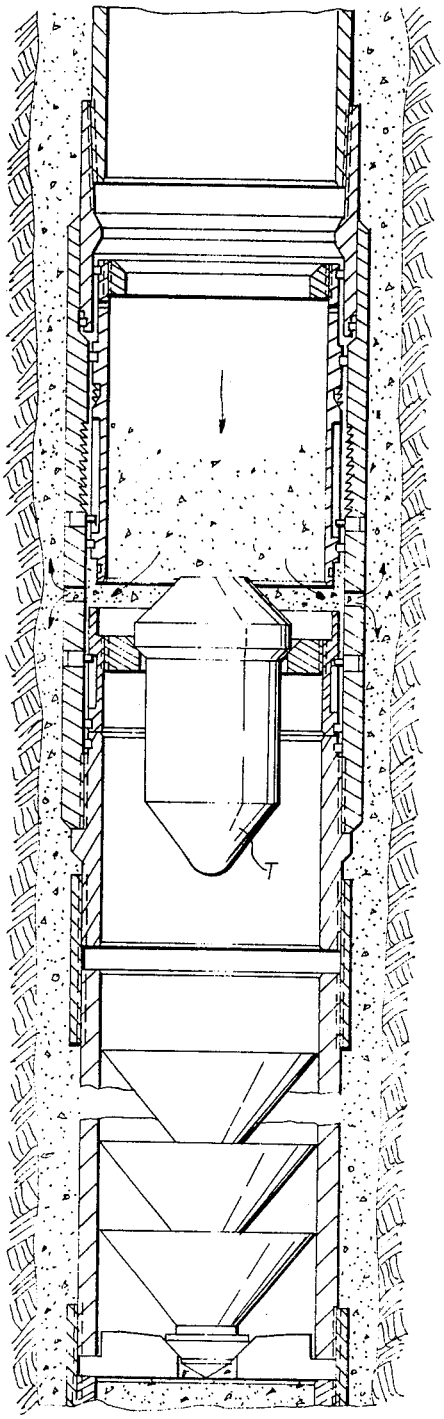
FIG. 1B is another longitudinal fragmentary cross-sectional view of the apparatus of FIG. 1A and disclosing the apparatus distributing cement after the ports have been opened.

Closing seat or collar 84, as best shown in FIG. 1A is preferentially screwed into the upper end of closing sleeve 14 and is positioned so as not to block apertures 82. Collar 84 is co-axial with body 10 and has a central aperture 86 co-axial with but larger than aperture 50 of collar 48.

In the initially assembled state, cement distribution apparatus A is selectively positioned in a length of well casing C and cement distribution ports 30 are blocked by opening sleeve 12. Cement may be pumped down casing C and through apparatus A and casing C to cement the bottom of the well and to a pre-selected height in bore hole H. Because apparatus A is hollow and collars 84 and 48 contain apertures 86 and 50, the cement is free to flow through apparatus A.

Another embodiment of the invention is best shown in FIGS. 6A through 11. Cement distribution apparatus B has a body 88; a closing sleeve 90; an opening sleeve 92; and an outer sleeve 94. Body 88 is threaded onto body coupling 96 which is connected to a length of well casing C. Likewise, at its upper end body 88 is connected to coupling 98 which connects to well casing C.

Body 88 as best shown in FIG. 8. is a substantially elongated cylinder having a central longitudinally extended aperture running the full length of the body 88. At the lower end of body 88 are 10 equi-angularly spaced apertures 100. Spaced above apertues 100 are 10 equi-angularly spaced slots or cement distribution ports 102. Above the ports 102 are 15 equi-angularly spaced apertures 104. A set of spaced, co-axial, co-operating annular toothed flanges 106 extend around the internal circumference of body 88 at a distance from apertures 104. At the lower end of body 88, at a distance from apertures 100, is another set of spaced, annular, co-axial, co-operating toothed flanges 108 extending circumferentially around the exterior of body 88. Toothed flanges 108 in the preferred embodiment have smaller sized teeth than do toothed flanges 106.

Opening sleeve 92, as best shown in FIG. 9, is mounted co-axially in body 88. Opening sleeve 92 is substantially cylindrical shaped and has a longitudinally extending central opening for passage of cement. Opening sleeve 92 contains 10 lower bores 110 and 10 upper bores 112 for positioning opening sleeve 92 in body 88. Bores 110 and 112 do not penetrate through opening sleeve 92.

Closing sleeve 90, as best shown in FIG. 10, is substantially cylindrically shaped and has a central longitudinally extending aperture. Sleeve 92 has 10 positioning bores 114 located toward the lower end of sleeve 90. Bores 114 are equi-angularly spaced around the external circumference of sleeve 90 and do not penetrate through sleeve 90. Four longitudinally extending slots 116 are equi-angularly positioned about the external circumference of sleeve 90 and the lower end of slots 116 are adjacent to bores 114 and two bores 114 are positioned between each pair of slots 116. At the upper end of sleeve 90 are six pressure relieving or bleed holes 118. Sleeve 90 has a notch 120 and a shoulder 122 containing an annular groove 124 for holding an O-ring 126, as best shown in FIG. 11. At the extreme upper end of sleeve 90 is another groove 128 for holding an O-ring 130. Sleeve 90 has a material thickness from groove 124 to almost its lower end which is substantially thicker than the thickness of the material toward the upper end designated an neck N. Bleed holes 118 pass through neck N for relieving the internal pessure. At the lower end of sleeve 90 is a groove 132 for holding an O-ring 134. At the extreme lower end is groove 136 for holding a flexible seal ring 138. Closing sleeve 90 is positioned above opening sleeve 92. Sleeve 90 is co-axial with opening sleeve 92.

Outer sleeve 94, as best shown in FIG. 11, is mounted circumferentially and co-axially around body 88. Outer sleeve 94 has a number of auxiliary cement distribution ports 140 located towards its upper end. Ports 140 are equi-angularly spaced around outer sleeve 94 and 10 ports 140 preferable. An equal number of apertures 142 are axially positioned adjacent ports 140. Outer sleeve 94 has an internal notch 144 located some distance below apertures 142. Notch 144 extends circumferentially around the internal circumference of sleeve 94.

Figure 6A:
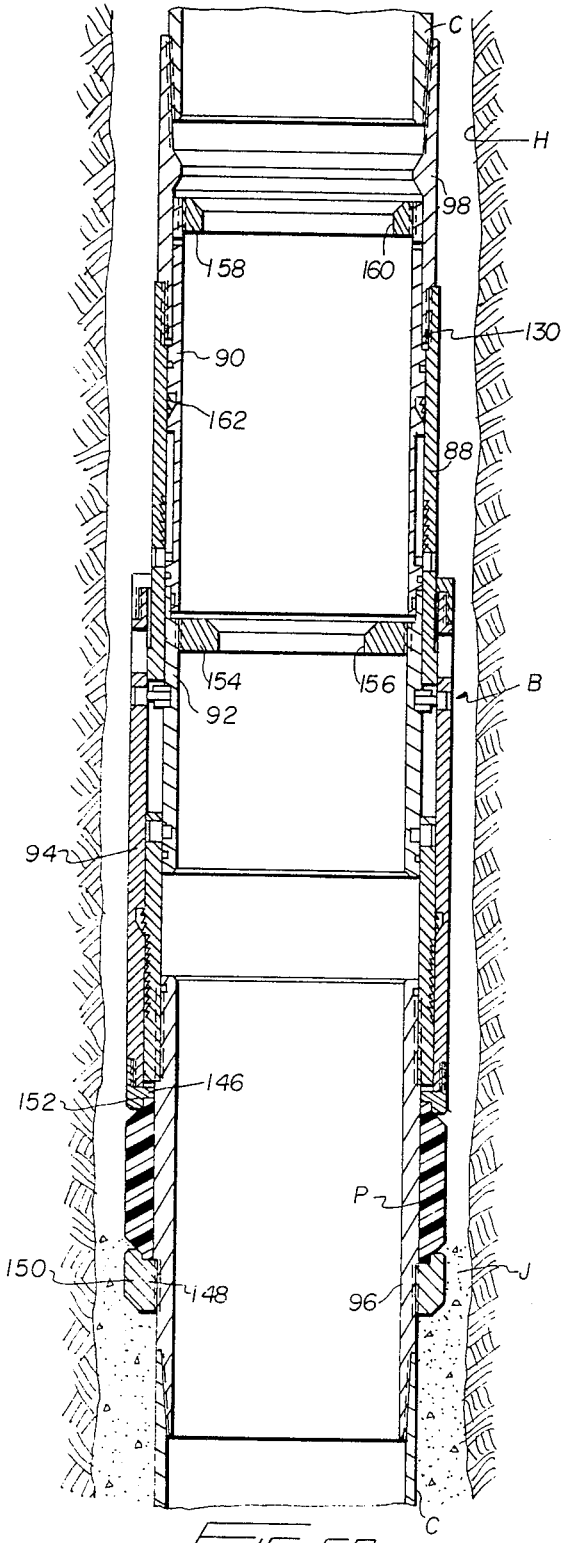
FIG. 6A is a fragmentary longitudinal cross-sectional view of another embodiment of the invention and disclosing a packer ring mounted about the apparatus.

Upper gauge ring 146, as best shown in FIG. 6A, is mounted to the lower end of outer sleeve 94. Upper gauge ring 146 is slidably associated with bottom coupling 96. Bottom coupling 96 is co-axial with opening sleeve 92 and is fastened to body 88 and has a lower gauge ring 148 circumferentially and fixedly extending around bottom coupling 96. Lower gauge ring 148 and upper gauge ring 146 have opposed shoulder 150 and 152 respectively, for holding resilient packer P. Packer P is constructed of a resilient material and is annularly shaped for being retained by shoulders 150 and 152.

Force receiving collar or opening seat 154 is positioned in opening sleeve 92 and has a central axial aligned aperture 156, which includes a flared shoulder extending upwardly. A pressure receiving collar or closing seat 158 is co-axially positioned in closing sleeve 90 and contains a co-axial aperture 160 which includes an upwardly expanding collar. Aperture 160 is larger in size than aperture 156.

In the assembled apparatus B, as best shown in FIG. 6A, closing sleeve 90 including closing seat 158 is positioned in body 88. Retaining ring means 162 which has a number of co-axial, spaced, co-operating toothed flanges circumferentially positioned thereon is positioned in notch 120 as best shown in FIG. 11. Guiding bolts or screws 164 are inserted in apertures 104 and enter guide slots 116. There is one guide bolt 164 for each slot. Frangible screws or bolts 166 are likewise inserted in bores 114 to detachably secure closing sleeve 90 in body B.

Opening sleeve 92, including opening seat 154, is inserted into body 88 and blocks cement distribution ports 102. Frangible screws or bolts 168 are inserted in apertures 100 for detachably securing opening sleeve 92 in body 88.

Outer sleeve 94 is positioned around the body 88 and includes upper gauge ring 146. Retaining ring 170 is positioned in notch 144 and has a number of radially extending sized, spaced, co-operating toothed flanges. A bushing 172 and frangible bolts or screws 174 are positioned in ports 102 and line up with bores 112 and enter into bores 112 and detachably secure outer sleeve 94 to body 88.

Finally, bottom coupling 96 is positioned in body 88 and packer P and lower gauge ring 148 is fastened thereto to hold packer P.

Consequently, an apparatus has been devised which has a central longitudinal extending aperture allowing free flow of cement, or other flowage, throughout its length so that a well casing may be cemented in stages.

OPERATION

Figure 6B:
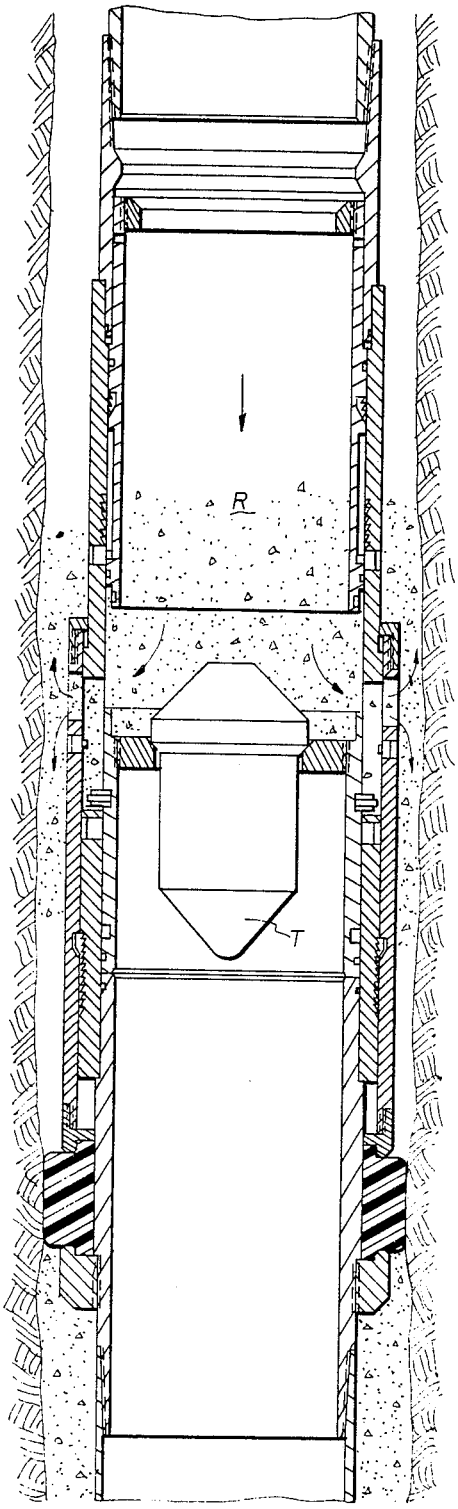
FIG. 6B is another fragmentary longitudinal cross-sectional view of the apparatus of FIG. 6A and disclosing the packer ring sealing the well casing to the bore hole.

A well is drilled to the desired depth prior to use of the disclosed invention. Once the well has been drilled, it is necessary to install the well casing, more particularly, casing having a number of links of well casing C, in the bore hole H. The casing is inserted in the bore hole H and lowered and a cement distribution, as best shown in FIGS. 1A–1D, apparatus A or B, as best shown in FIGS. 6A and 6B, is included in the casing and is positioned in the drill string so that the cement distribution apparatus A or B is located at a pre-selected depth in the well. After the casing, including the cement distribution apparatus A or B, is positioned in the well it is necessary to cement the well casing C to the bore hole H so that the casing will remain positively positioned in the bore hole H and seal desirable strata. After completing the positioning of the casing in the bore hole H, the casing is connected to a source for providing pressurized cement.

The term cement is intended to include a slurry of materials which may be pumped down the well casing C and which will set to a sufficient hardness to accomplish the desired objectives of the cementing operation. The term cement slurry is intended to include hydraulic cements and plastics. Hydraulic cements include such cements as portland, either the normal type or the slow setting type, and also mixtures of lime, silica and alumina, or of lime and magnesia, silica and alumina and iron oxide. The term hydraulic cement includes hydraulic limes, grappier cements, pozzolan cements and natural cements. Included in the term plastics are thermosetting plastics. Consequently, it can be seen that the invention is not limited to any particular cement but includes any liquid or slurry type material which may accomplish the objectives of the invention.

Upon connection of the casing to the supply of pressurized cement the casing is ready for the first stage of cementing. The cement is pumped down the interior of the well casing C through the cement distribution apparatus A or B and continues down well casing C to exit from the end of the last piece of well casing C. The highly pressurized cement flows from the exit end or open end of the last piece of well casing C and into the bore hole H and progressively fills the bore hole H from the bottom toward the top of the bore hole H. The cement surrounds the exterior of well casing C and fills the voids between the exterior of well casing C and the interior of bore hole H. Initially the cement readily issues from the open end of the last piece of well casing C and begins to ascend the bore hole H. As the cement progressively fills the bore hole H however, the amount of pressure required to pump the cement from the well casing C increases due to the weight of the cement in the void between the well casing C and the bore hole H. Consequently, greater and greater amounts of pressure are required in order for the cement to progressively advance up the bore hole H. At a certain point it becomes impractical or uneconomical to continue increasing the pumping pressure to advance the level of the cement. At this point the pumping is stopped and the apparatus and process of the invention come into play.

After cementing of the first stage J, as best shown in FIGS. 1A and 6A, a flexible cementing plug 176, as best shown in FIG. 1A, is pumped down the well casing C through the cement distribution apparatus A or B following the first stage J.

The cementing plug 176 is flexible and resilient so that it may pass through apertures 50 and 86 and apertues 156 and 160 of cement distribution apparatus A or B respectively. The collar 176 has a central aperture 178 which is co-axial with the axis of the casing and well casing C. Collar 176 has a radially extending flange for positioning within the gap between opposed pieces of well casing C positioned in 28, as best shown in FIG. 1A. After seating of flexible plug 176 on the top of the first stage J cement, a flexible cementing plug or well casing cleaner 180 is pumped down the interior of casing C. Well casing cleaner 180 has a substantially conical sealing end with a mandrel (not shown) longitudinally extending therefrom. A number of sized, spaced, co-axial conically shaped wiper cups are mounted about the mandrel (not shown) to wipe the interior of casing C free from cement. Well casing cleaner 180 has the desirable effect of cleaning the upwardly extending portions of apertures 86 and 50 and 156 and 160 respectively. Well casing cleaner 180 is flexible, including its mandrel (not shown), for ease in pumping down the casing C. When the well casing cleaner 180 is positioned in the casing C a pumping force is necessary to position it onto collar 176. Preferably water or another non-hardening material is used to pump the casing cleaner onto collar 176. As the cleaner 180 progressively passes down the casing C it wipes the cement from the casing and the cement distribution apparatus A or B and the water keeps the casing interior from becoming hardened and prevents any residual cement from hardening. Although water is disclosed for pumping the well casing cleaner 180, it can be appreciated that other types of fluids are possible. As the well casing cleaner 180 passes down the casing C any residual cement is likewise pumped down and the exterior level of the cement in the bore hole H may be raised somewhat thereby.

In another embodiment of the process of the invention, well casing cleaner 180 may be pumped down the casing C by means of pressurized cement. This may be necessary if high pressures are involved and the weight of the extra head of cement in the casing C is necessary to prevent the well casing cleaner 180 from being displaced upwardly.

In this embodiment, a second flexible collar 176 and well casing cleaner 180 are pumped down to a second level so that the second stage of cementing may be accomplished. The seconed well casing cleaner 180 will preferentially be pumped down by means of pressurized water or other non-hardening fluids.

After the well casing cleaner 180 has been positioned on flexible collar 176, the second stage of cementing may be begin. A weighted trip bomb T is dropped down the interior of well casing C, through closing seat 84 and lands on opening seat 48 with sufficient force to break frangible members 44. Trip bomb T is substantially cylindrical and has a conical nose on one end and a shouldered end opposite the nose end for seating on the upwardly extending aperture 50. Trip bomb T is substantially cylindrical and the shoulder end is substantially annular so that the shoulder end seats in the upwardly expanding aperture 50 and is sealed thereon. Trip bomb T may preferentially be filled with lead to add weight to increase its kinetic energy upon impact on opening seat 50.

APPARATUS A (FIGS. 1A through 5)

After trip bomb T is seated and sealed in aperture 50 of opening seat 48, the second stage cementing process may begin. Cement is again pumped down casing C but is prevented from passing through aperture 50 because of trip bomb T. After approximately 1,000 pounds of pressure have been built up in casing C, opening sleeve 12 will begin to slide in guide slots 40. Frangible members 44 have been broken in bores 46 so that sleeve 12 is free to slide when sufficient pressure is applied. As sleeve 12 begins to slide, flange 38, which blocks ports 30 begins to be displaced because it is an integral part of sleeve 12. As sleeve 12 is displaced toward the bottom of the well, flange 38 begins to unblock ports 30. Sleeve 12 travels down body 10 until stopped by guide bolts 42 engaging the end of longitudinal slots 40. At this point ports 30 are wholly unblocked and the cement flows through ports 30 and into bore hole H.

Figure 1C:
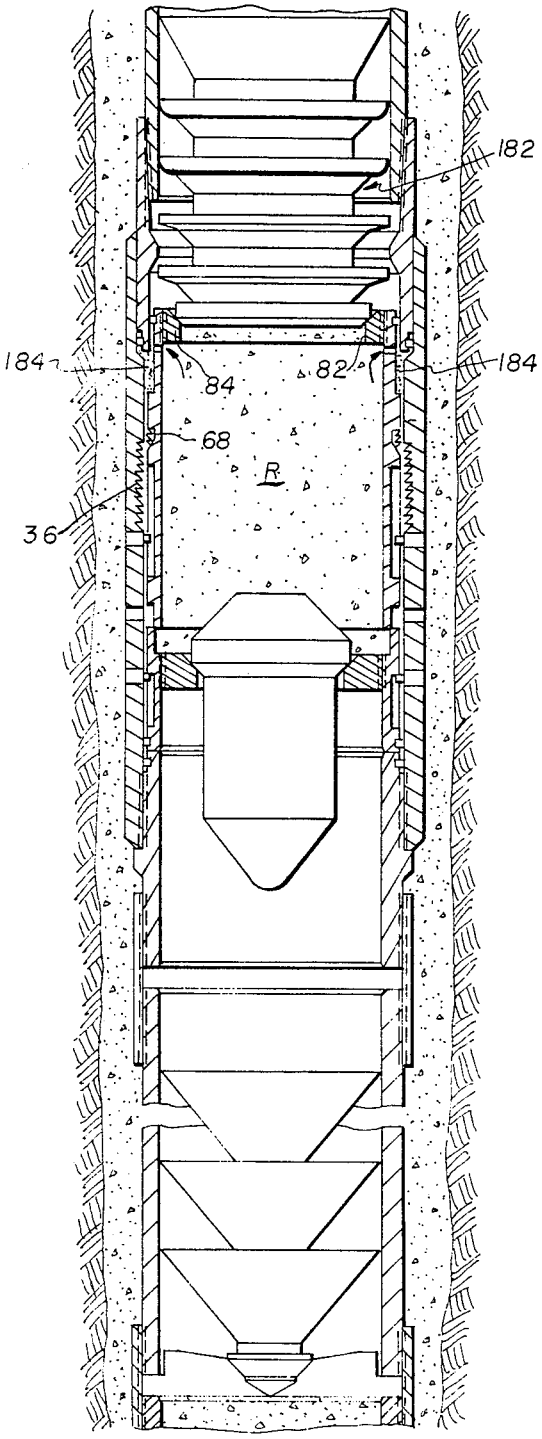
FIG. 1C is another fragmentary longitudinal cross-sectional view of the apparatus of FIG. 1A and disclosing a casing cleaner used to clean the casing and to close the cement distribution ports.
Figure 1D:
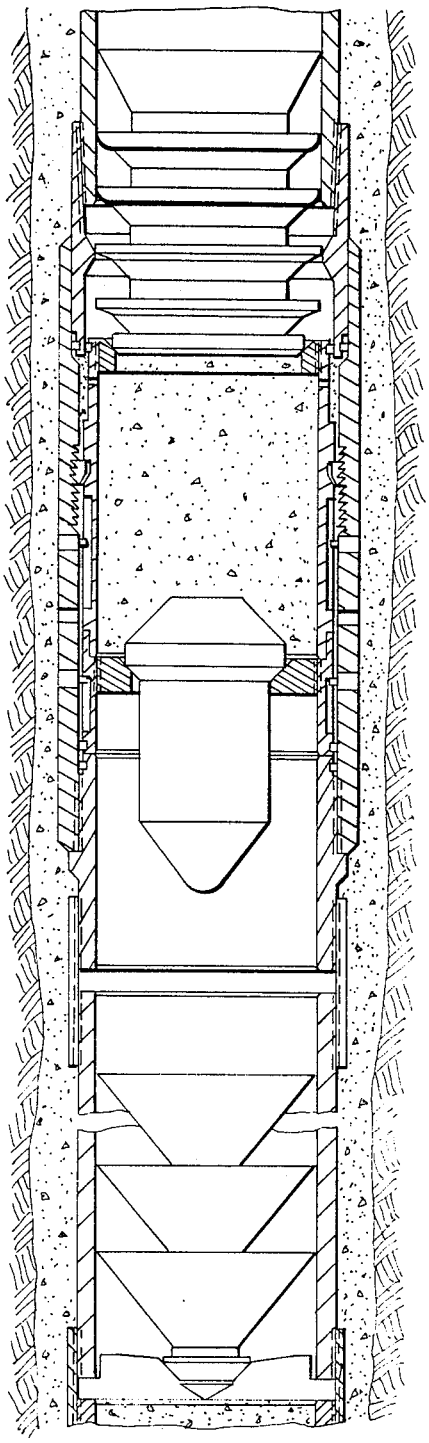
FIG. 1D is another longitudinal fragmentary cross-sectional view of the apparatus of FIG. 1A in which the cement distribution ports have been closed and the closing sleeve has been locked in position.

Cement is pumped down the well casing C and out ports 30 until either the pressure head due to the cement in the bore hole H is too great or until a predetermined level has been reached. Once the predetermined supply of cement has been pumped down the casing C, it is necessary to close ports 30. A closing plug assembly or casing cleaner 182, as best shown in FIG. 1C and 1D, is pumped down well casing C. Casing cleaner 82 has a lower end containing a landing member with a contour adapted for seating and sealing with the upwardly expanding aperture 86 of closing seat 84. Casing cleaner 182 has a number of spaced, co-axial, co-operating wiper elements longitudinally extending the length of casing cleaner 182 and radially extending therefrom to wipe the interior of the casing C. As casing cleaner 182 progresses down the casing C the wiping elements remove any cement which may be attached to the interior of casing C. Casing cleaner 182 is normally pumped down by means of pressurized water or other pressurized fluids so as not to block the interior of casing C. After landing on closing seat 84, the pressure builds up in casing C until sufficient pressure is generated to break frangible members 62 and allow closing sleeve 14 to begin to be displaced. Preferentially, the force required to break frangible members 62 and move closing sleeve 14, is higher than the pressure required to displace opening sleeve 12.

As closing sleeve 14 is longitudinally displaced in body 10, lock ring, or ring retaining means 68, engages flanges 36. The toothed flanges on lock ring 68 engage and co-operate with the toothed flanges 36 and prevent closing sleeve 14 from changing its direction or being displaced upwardly by the force of the pressure head of the cement in bore hole H. Ring 68 has a ratchet type effect with toothed flanges 36 such that the ring 68 moves from the upwardmost toothed flange to somewhere near the lowermost toothed flange. In this way ports 30 are blocked by closing sleeve 14 and the pressure of the cement in the bore hole H may not enter casing C and upwardly displace closing sleeve 14 or casing cleaner 182.

As closing sleeve 14 is being displaced, shoulder S likewise moves down and an annular chamber 184 is created between body 10 and closing sleeve 14 because shoulder S has a reduced thickness compared to the thickness of sleeve 14 adjacent shoulder S. As the shoulder S is progressively moved lower by sleeve 14, the chamber 184 increases in size. Apertures or bleed holes 82 extending through shoulder S communicate with chamber 184 so that excess pressure generated by the closing of the sleeve 14 permits the excess pressure and material to be bled or vented into chamber 184. Normally, as casing cleaner 182 progesses down casing C any accumulated cement moves down likewise and into what may be thought to be a container or canister R defined by body 10, opening sleeve 12, collar 48 and trip bomb T. The lowering of casing cleaner 182 closes this canister R. As the volume of the canister R decreases with the ratching down of closing sleeve 14, pressure in the canister R increases. Because of the bleed holes 82, the excess pressure is relieved and it is therefore easier to lower casing cleaner 182 and thereby closing sleeve 14 because of this reduced pressure. Should the annular chamber 184 and bleed holes 82 not be present then extremely high pressures are necessary to force closing sleeve 14 to close ports 30 by means of casing cleaner 182. Consequently, the use of bleed holes 82 and annular chamber 184 permits the closing of closing sleeve 14 with the casing cleaner 182, at much lower pressure than would be attainable without the bleed holes 82 and the annular chamber 184.

After closing sleeve 14, the casing C may be drilled or bored out by means well known in the art, to remove casing cleaner 182, the cement contained within the body 10, trip bomb T, well casing cleaner 180, flexible collar 176 and the cement contained in casing C in the first stage of cementing. Consequently, an improved and relatively simple method for cementing a well casing in a bore hole and permitting the relatively rapid use of the casing C to remove the desirable products has been disclosed.

APPARATUS B (FIGS. 6A through 11)

In the embodiment disclosed in cement distribution apparatus B the process is substantially similar. When the trip bomb T lands on the opening seat 154, the force breaks the frangible bolts 168 holding opening sleeve 92 in body 88. The opening sleeve 92 is now free to be displaced by the pressure from the pumped cement. Opening sleeve 92 is connected to outer sleeve 94 by means of frangible bolts 174 and bushing 172. Outer sleeve 94 is forced downwardly by the pressure and upper gauge ring 146 begins to axially act on packer P. As outer sleeve 94 continues to be lowered, toothed flanges of the retaining ring 170 ratchet down on toothed flanges 108 to lock outer sleeve 94 and to prevent it from being displaced upwardly. Packer P is prevented from being lowered because of lower gauge ring 148 and shoulder 150 and therefore as outer sleeve 94 continues to be displaced downwardly packer P expands radially, as best shown in FIG. 6B, and seals the bore hole H to the well casing C. Packer P may only radially expand so far before its further radial expansion is prevented because of bore hole H. After this point is reached, frangible bolts 168 break and at this point auxiliary bores 140 are adjacent slots 102 and cement may now be distributed in the bore hole H. The closing of the closing sleeve 90 is performed in the previously explained matter.

The advantages of the embodiment of cement distribution apparatus B are that it is not necessary that the first stage cement cure, prior to use of the cement distribution apparatus B. Once the first stage cement has been pumped the trip bomb T may be immediately dropped down the casing C to expand the packer P and break bolts 168. In this way, the first stage and the second stage cement may cure independently of each other the cementing of the well may be quickened because of the lack of need to allow the first stage J cement to cure prior to use of the second stage apparatus. Consequently, it can be appreciated that use of the packer ring P results in improved speed and efficiency in the cementing of casing in the well.

While this invention has been described as having a preferred embodiment, it is understood that it is capable of further modification, uses, and or adaptations following in general the principles of the invention including such departures from the present disclosure as have come within known or customary practice in the art to which the invention pertains, and as may be applied to the central features hereinbefore set forth, and fall within the scope of the invention as limited by the appended claims.

What is claimed is:

1. A cement staging apparatus for wells and including well casing, comprising:

(a) an open ended hollow body having a number of spaced ports therethrough;

(b) a first hollow member slideably associated with said body and having a first ports closed position and a second ports open position;

(c) first pressure means associated with said first member for displacing said first member and opening said ports thereby;

(d) a second hollow member slideably associated with said body and having a first ports open position and a second ports closed position and including shifting pressure relieving means cooperating with and internal of said body and adapted for facilitating sliding of said second member from said first to said second position;

(e) second pressure means associated with said second member for displacing said second member and closing said ports thereby;

(f) said second member spaced a distance from said first member;

(g) said body, said first member and said first pressure means defining a canister having an open end for receipt of a supply of pressurized cement and adapted for distributing said cement through said ports; and, (h) said body, said first and said second pressure means and said second member define a closed canister when in said second position preventing the distribution of an additional supply of cement whereby closing of said canister by sliding of said second member in cooperation with said second pressure means causes said pressure relieving means to shift and to relieve and vent said canister pressure and thereby facilitate sliding of said second member from said first to said second position.

2. A cement staging apparatus as defined in claim 1, wherein:

a. said body is substantially cylindrically shaped and has a central longitudinal axis; and b. said first and said second sliding members are substantially cylindrically shaped.

3. A cement staging apparatus as defined in claim 2, wherein:

a. said first and said second sliding members are coaxially mounted in said body interior.

4. A cement staging apparatus as defined in claim 3, wherein:

a. said second sliding member is mounted a distance above said first sliding member.

5. A cement staging apparatus as defined in claim 4, further comprising:

a. frangible securing means associated with said body and connected to said first sliding member for detachably securing said first sliding member; and b. force receiving and transmitting means mounted in and displaceable with said first sliding member for receiving a force and transmitting said force to said frangible securing means to cause said means to break and allow said first sliding member to be substantially free to be displaced by said first pressure means.

6. A cement staging apparatus as defined in claim 5, wherein:

a. said force receiving and transmitting means includes a collar having a central aperture coaxial with said body axis and adapted for cooperating with and being sealed by a substantially cylindrically shaped trip bomb.

7. A cement staging apparatus as defined in claim 6, wherein:

a. said collar is located below said body ports after said first sliding member has been displaced to open said ports.

8. A cement staging apparatus as defined in claim 2, wherein:

a. said first sliding member includes an axially extending annular flange for closing said body ports before said first sliding member is displaced.

9. A cement staging apparatus as defined in claim 2, wherein:

a. said second sliding member includes a sized spaced annular shoulder;

b. displacement of said second member creates an annular chamber between said body and said second member adjacent said second member annular shoulder;

c. a number of apertures in said shoulder communicate with said annular chamber when said second member is displaced for allowing pressure in said closed cannister to be relieved into said annular chamber.

10. A cement staging apparatus as defined in claim 9, further comprising:

a. pressure receiving and transmitting means are mounted in said second member a distance above said second member apertures for receiving a pressure and transmitting said pressure to said second member to cause said second member to be displaced.

11. A cement staging apparatus as defined in claim 10, wherein:

a. said pressure receiving and transmitting means includes a collar having a coaxial aperture coaxially mounted in said second member and adapted for cooperating with and being sealed by a casing cleaner.

12. A cement staging apparatus as defined in claim 11, wherein:

a. said casing cleaner includes a number of sized, spaced, coaxial, annular associated members for wiping a well casing interior.

13. A cement staging apparatus as defined in claim 1, further comprising:

a. upper and lower means for connecting said body to well casing for positioning said body at a preselected point in said well.

14. A cement staging apparatus as defined in claim 13, further comprising:

a. well casing cleaning means displaceable in said well casing and adapted for being displaced through said pressure receiving and transmitting means and said force transmitting and receiving means for cleaning said well casing interior.

15. A cement staging apparatus as defined in claim 14, wherein:

a. said well casing cleaning means includes a number of flexible, sized, spaced, coaxial, conical associated members.

16. A cement staging apparatus as defined in claim 2, further comprising:

a. said first sliding member exterior surface containing a number of longitudinally extending slots;

b. said body includes a number of slot guiding means associated therewith for cooperating with said first member slots for guiding said member and preventing rotation of said member.

17. A cement staging apparatus as defined in claim 2, further comprising:

a. a number of longitudinally extending slots located in said second member exterior; and b. slot guiding means associated with said body for cooperating with said second member slots and for guiding said second member and preventing rotation of said member.

18. A cement staging apparatus as defined in claim 2, further comprising:

a. means for allowing displacement of said second member in one direction only.

19. A cement staging apparatus as defined in claim 18, wherein:

a. a number of sized, spaced, coaxial, associated toothed shaped annular flanges are circumferentially located about said body interior; and b. retaining ring means coaxial with and circumferential with said second member exterior cooperate with said toothed flanges and engage said flanges when said second member is displaced for preventing said second member from changing said member's direction of displacement.

20. A cement staging apparatus as defined in claim 19, wherein:

a. said retaining ring includes a number of sized, spaced, coaxial, associated circumferential toothed flanges for cooperating with and engaging said body toothed flanges.

21. A cement staging apparatus as defined in claim 2, further comprising:

a. well engaging means connected to said body at a distance from said body for sealing said well and said casing; and b. means for causing said well engaging means to seal against said well.

22. A cement staging apparatus as defined in claim 21, wherein:

a. said well engaging means includes an annular resilient packer;

b. a third annular member coaxial with said body and extending a distance from said body and including fixed annular packer retaining means;

c. a fourth annular member detachably mounted to said body and displaceable with said first sliding member; and d. packer retaining and compressing means mounted to said fourth member for continuously retaining said packer and causing said packer to compress and to engage said well when said fourth member is displaced with said first sliding member.

23. A cement staging apparatus as defined in claim 21, further comprising:

a. means for allowing displacement of said fourth member in one direction only.

24. A cement staging apparatus as defined in claim 23, wherein:

a. a number of sized, spaced, annular, coaxial, associated circumferential toothed flanges are associated with said body exterior; and b. annular ring retaining means are associated with said fourth member for cooperating with said body external toothed flanges for engaging said body external toothed flanges to prevent said fourth member from changing said member's direction of displacement.

25. A cement staging apparatus as defined in claim 24, wherein:

a. said retaining ring means includes a number of sized, spaced, annular, coaxial associated toothed flanges externally and circumferentially associated therewith.

26. A cement staging apparatus as defined in claim 22, wherein:

a. frangible means are associated with said body and said fourth member for preventing the unintended displacement of said fourth member and for cooperating with said force receiving and transmitting means.

27. A process for cementing a well in stages, comprising the steps of:

a. lowering a length of well casing having an open ended cement distribution apparatus positioned therein into said well whereby said apparatus is at a preselected depth in said well;

b. closing one end of said apparatus to permit opening of said apparatus cement distributing ports;

c. connecting said cement distribution apparatus to a source of pressurized cement;

d. supplying a predetermined amount of pressurized cement to said apparatus to open said ports and to distribute a substantial portion of said cement into said well;

e. closing said ports after said predetermined amount of said cement has been supplied; and f. relieving said apparatus pressure to assist the closing of said ports.

28. A process as defined in claim 27, further comprising the steps of:

a. cementing said well casing in a first stage to a predetermined depth in said well prior to closing said one end of said apparatus.

29. A process as defined in claim 28, further comprising the steps of:

a. allowing said first stage cement to substantially cure prior to closing said one end.

30. A process as defined in claim 29, further comprising the steps of:

a. lowering a float collar onto said first stage cured cement; and b. lowering a well casing cleaner onto said collar prior to closing said one end of said apparatus to substantially clean said well casing interior.

31. A process as defined in claim 27, further comprising the steps of:

a. closing of said one end of said apparatus for initiating a packer for sealing said well casing exterior and said well.

32. A process as defined in claim 30, further comprising the steps of:

a. lowering a second float collar into said well casing; and b. lowering a second well casing cleaner onto said second collar to substantially clean said casing interior.

33. A process as defined in claim 30, further comprising the steps of:

a. lowering of said collar and said casing cleaner is accomplished by use of a pressurized material other than cement.

34. A process as defined in claim 32, wherein:

a. lowering of said collar and said well casing cleaner is accomplished by use of pressurized cement.

35. A process as defined in claim 34, wherein:

a. lowering of said second collar and said second well casing cleaner is accomplished by use of a pressurized material other than cement.

36. A process as defined in claim 29, further comprising the steps of:

a. continuously supplying a relatively small amount of cement to said apparatus to prevent said ports from becoming blocked.

37. A process as defined in claim 27, further comprising the steps of:

a. isolating said first stage of cement from said second stage of cement prior to said first stage becoming cured.

* * * * *